US006209498B1

(12) United States Patent
Brothers

(10) Patent No.: US 6,209,498 B1
(45) Date of Patent: Apr. 3, 2001

(54) ROLLER VALVE LIFTER WITH OILING CHANNEL

(75) Inventor: Paul Brothers, Memphis, TN (US)

(73) Assignee: Competition Cams, Inc., Memphis, TN (US)

( * ) Notice: Subject to any disclaimer, the term of this patent is extended or adjusted under 35 U.S.C. 154(b) by 0 days.

(21) Appl. No.: 09/203,015

(22) Filed: Dec. 1, 1998

(51) Int. Cl.[7] ..... F01L 1/14; F01M 9/10
(52) U.S. Cl. ..... 123/90.5; 123/90.35
(58) Field of Search ..... 123/90.48, 90.5, 123/90.33, 90.35

(56) References Cited

U.S. PATENT DOCUMENTS 3,314,303 * 4/1967 Maat ..... 123/90.35
4,708,102 * 11/1987 Schmid ..... 123/90.35
4,741,298 * 5/1988 Rhoads ..... 123/90.5
4,747,376 * 5/1988 Speil et al. ..... 123/90.55
4,809,651 3/1989 Gerchow et al. ..... 123/90.5
5,022,356 6/1991 Morel, Jr. et al. ..... 123/90.5
5,127,374 * 7/1992 Morel, Jr. et al. ..... 123/90.35
5,186,130 * 2/1993 Melchior ..... 123/90.35
5,188,068 * 2/1993 Gaterman, III et al. ..... 123/90.35
5,566,652 * 10/1996 Deppe ..... 123/90.35
5,673,661 * 10/1997 Jesel ..... 123/90.48
5,806,475 9/1998 Hausknecht ..... 123/90.16

* cited by examiner

*Primary Examiner*—Weilun Lo
(74) *Attorney, Agent, or Firm*—Banner & Witcoff, Ltd.

(57) ABSTRACT

A valve lifter of the present invention includes a tappet body having a forked housing for receiving a cylindrical roller. The cylindrical roller is provided with a bearing assembly and a shaft extending therethrough to operatively couple the roller to the forked housing. To provide lubrication to the cylindrical roller and bearing assembly, the tappet body includes an oil pressure feed groove, oil feed slots, and an oiling channel located on the external surface of the tappet body.

9 Claims, 1 Drawing Sheet

ROLLER VALVE LIFTER WITH OILING CHANNEL

FIELD OF THE INVENTION

The present invention relates to a roller valve lifter having a roller at one end thereof that cooperates with the cams of a camshaft in an internal combustion engine. More specifically, the invention relates to a valve lifter having an oiling channel to improve oil flow to the roller, roller bearing and the cam of a camshaft.

BACKGROUND OF THE INVENTION

Internal combustion engines utilize valve lifters that operate in conjunction with cams of a camshaft to reciprocate the lifters. Typically, as the camshaft rotates, the cams of the camshaft operatively engage an end of the valve lifter to reciprocate the valve lifters in an internal combustion engine. The valve lifters are located within cylindrical bores in an engine block. The engine block provides a travel passageway for each valve lifter and allows oil to lubricate each lifter assembly. Oil is directed to the valve bores by a straight and common transverse oil passageway that intersects the valve bores.

Various valve lifter designs have been developed for specific engine environments. Hydraulic valve lifter assemblies and solid lifters are typically used for engines having relatively low revolutions per minute. Rolier valve lifters, which utilize a roller to contact the cams of a camshaft, are typically used in engines having relatively high revolutions per minute. The use of a roller to contact the cams reduces wear and extends the useful life of both the valve lifter and the cams of the camshaft.

One problem associated with valve lifters is the need to provide oil to the lifters as they reciprocate within the valve bores and to the valve lifter rollers and cams of the camshaft as the lifters ride on the cams. When using roller valve lifters, it is important to provide sufficient oiling of the rollers and cams particularly at the point of contact. A known approach to increase the oiling of these areas is to provide an oil pressure feed groove on the valve lifter. This oil pressure feed groove is typically an annular groove on the circumference of the tappet body of the valve lifter. Oil enters the oil pressure feed groove from the common transverse oil passageway in the engine block that intersects the valve bores. As the valve lifter reciprocates within the engine, the oil pressure feed groove carries oil up and down the valve lifter bore and also directs oil towards the roller of the valve lifter that engages the cam. Although this method serves to provide some quantity of oil to the rollers and cams, in an engine having high revolutions per minute, there is a need to maximize the quantity of oil flowing to the rollers and cams to decrease roller and cam wear.

Another problem associated with engines having high revolutions per minute and using roller valve lifters is the need to supply adequate oil to the roller bearings of the valve lifter. Inadequate oiling of the roller bearing results in excessive wear and may lead to catastrophic failure of the bearing, and consequently failure of the entire engine. A known approach to oiling the roller bearings is to provide an oil feed slot or slots in the portion of the valve lifter that houses the roller. This oil feed slot directs any oil at the distal end of the valve lifter towards the shaft and bearings of the roller. While this method attempts to provide oil to the roller bearing, oil may not be present in this area or may be directed away from the shaft and bearing due to the rotation of the cam. Thus, there is a need to provide a positive flow of oil to the roller bearings to ensure oiling of the roller bearings.

SUMMARY OF THE INVENTION

In accordance with a preferred embodiment of the present invention, a valve lifter assembly for use in internal combustion engines having improved oiling characteristics is provided. The invention preferably includes a cylindrical tappet body having a forked housing for receiving a cylindrical roller, wherein the cylindrical roller includes a bearing assembly and a circular opening for positioning about a shaft located in the forked housing. The tappet body further includes an oil pressure feed groove and oil feed slots located on inner planar surfaces of the forked housing. The invention further preferably includes an oiling channel located on an external surface of the tappet body to direct oil to the cylindrical roller and roller bearing assembly of the valve lifter.

The tappet body preferably includes a cylindrical bore extending from a first end along the longitudinal axis of the tappet body for receiving a rod to operatively connect the tappet body to a valve member. A second end of the tappet body preferably has a forked housing for receiving a cylindrical roller. The cylindrical roller preferably includes a bearing assembly consisting of bearing members and an inner race. The inner race contains a circular opening for receiving a shaft located in the forked housing. The shaft is connected to both sides of the forked housing on the tappet body, and the cylindrical roller is rotatably mounted to the shaft.

The valve lifter also preferably includes an oil pressure feed groove comprising an annular groove on the circumference of the tappet body of the valve lifter for receiving oil as the valve lifter reciprocates in the cylindrical bore of an engine block. The tappet body may also include oiling holes to provide oil to the rod member located in the cylindrical bore of the tappet body.

The first and second sides of the forked housing on the tappet body preferably have oil feed slots on an inner planar surface of each side. The tappet body further includes an oiling channel located on an external surface of the tappet body preferably extending from the oil pressure feed groove to the forked housing.

Therefore, the present invention facilitates the movement of oil to the cylindrical roller and the bearing of the roller. Features of the subject invention which provide the oiling properties include an oil pressure feed groove, oil feed slots and an oiling channel on the tappet body.

BRIEF DESCRIPTION OF THE DRAWINGS

Further advantages of an illustrative embodiment of the present invention will be more readily apparent from the following detailed description which proceeds with references to the accompany drawings.

Figure 2:
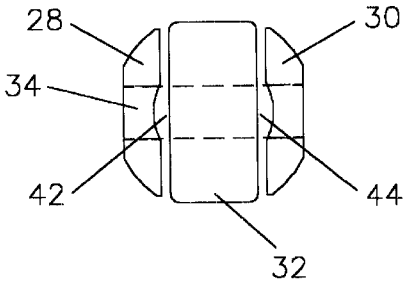
FIG. 2 is a bottom view of the second end of the tappet body having a forked housing and cylindrical roller.

While the invention is susceptible to various modifications and alternative forms, specific embodiments thereof are shown by way of example in the drawings and will herein be described in detail. It should be understood, however, that the drawings and detailed description thereof are not intended to limit the invention to the particular from disclosed, but on the contrary, the invention is to cover all modifications, equivalents and alternatives falling within the spirit and scope of the present invention.

DETAILED DESCRIPTION OF AN ILLUSTRATIVE EMBODIMENT

The Valve Lifter

The present invention is directed to a valve lifter 10 for an internal combustion engine having a plurality of valve members 12 and having a camshaft 14 for causing reciprocating movement of the valve members 12.

Figure 1:
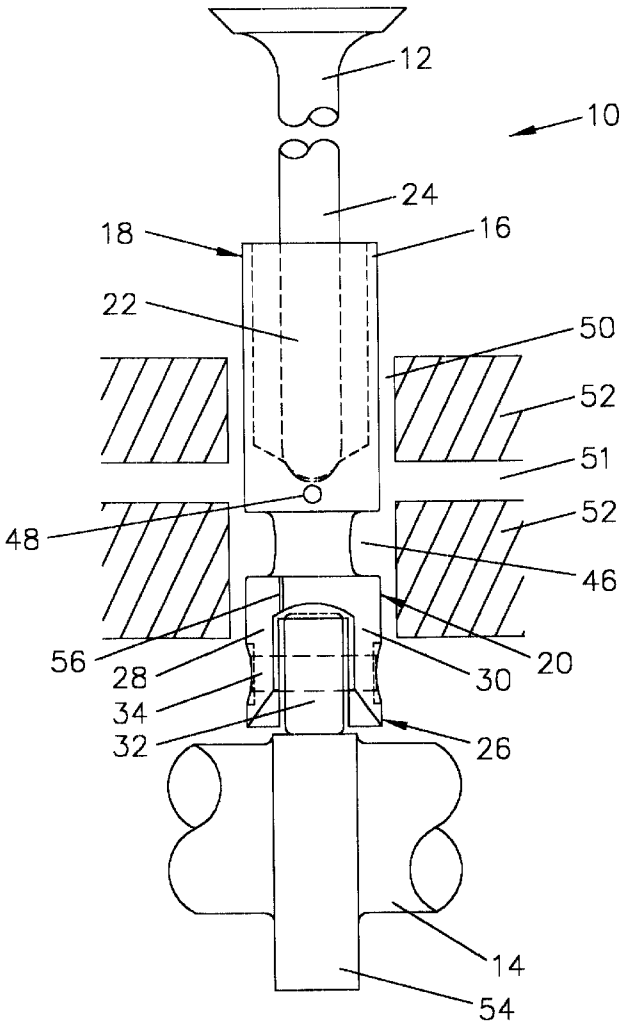
FIG. 1 is a side view of an embodiment of the valve lifter of the present invention.

As shown in FIG. 1, the valve lifter 10 includes a cylindrical tappet body 16 having a first end 18 and a second end 20. The tappet body is preferably made of high strength steel. First end 18 of the tappet body 16 contains a cylindrical bore 22 extending from the first end 18 of the tappet body 16, along the longitudinal axis of the tappet body 16 toward the second end 20 for receiving the distal end of a rod structure 24 which is associated either with a rocker arm assembly (not shown), or with a bucket to directly engage the valve member 12.

Figure 3:
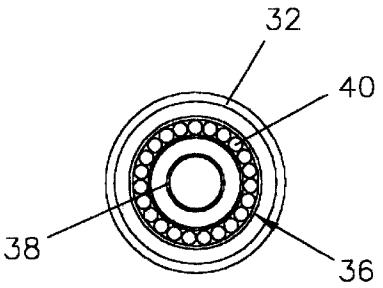
FIG. 3 is a side view of the cylindrical roller.

The second end 20 of the tappet body 16 includes a forked housing 26 having a first side 28 and a second side 30. The forked housing 26 is adapted to receive a cylindrical roller 32. The cylindrical roller 32 is rotatably mounted to the forked housing 26 by way of a shaft 34 connected to the first side 28 and the second side 30 of the forked housing 26. As shown in FIG. 3, the cylindrical roller 32 further includes a bearing assembly 36 consisting of an inner race 38 and bearing members 40 for providing a wear means for the cylindrical roller 32 as it rotates on the shaft 34.

In a preferred embodiment of the present invention, the second end 20 also contains a first oil feed slot 42 and a second oil feed slot 44. As shown in FIG. 2, the first oil feed slot 42 is a depression located on the inner planar surface of the first side 28 of the forked housing 26. Likewise, the second oil feed slot 44 is a depression located on the inner planar surface of the second side 30 of the forked housing 26. Oil feed slots 42 and 44 preferably extend between second end 20 and shaft 34. The oil teed slots 42 and 44 are also preferably 0.063 inches deep and 0.25 inches wide.

The valve lifter 10 may also contain an oil pressure feed groove 46 located on the valve tappet at body 16. Preferably, the oil pressure feed groove 46 is an annular groove on the circumference of the tappet body 16 of the valve lifter 10 and is located between the first end 18 and the second end 20 of the tappet body 16. Oil enters the oil pressure feed groove 46 from the common transverse oil passageway that intersects the valve bores 50. As the valve lifter 10 reciprocates within the engine, the oil pressure feed groove 46 carries oil up and down the valve lifter bore 50 and also directs oil towards the roller 32 of the valve lifter 10 that engages the cam 54. As known in the art, the valve lifter 10 may contain an oiling hole 48 located on the tappet body 16 between the first end 18 and the oil pressure feed groove 46. The oiling hole 48 provides oil to the cylindrical bore 22 of the valve tappet body 16 and thus the rod 24.

Oil Flow of the Valve Lifter

The valve lifter 10 is adapted to reciprocate in a bore 50 of an engine block 52 as illustrated in FIG. 1. As mentioned above, the engine block 52 includes a number of valve bores, bore 50 being exemplary of the remaining bores. The engine block 52 contains a straight and common transverse oil passageway 51 that intersects the valve bore 50. As the valve lifter 10 reciprocates in the valve bore 50, the oil pressure feed groove 46 receives oil from the common transverse oil passageway 51 and traps the oil between the valve body 16 and the valve bore 50 to maintain oil between the valve lifter 10 and the valve bore 50. The oiling hole 48 also receives oil from the reciprocating action of the valve lifter 10 in the valve bore 50.

The second end 20 of the valve lifter 10 also receives oil through the reciprocating action of the valve lifter 10 in the valve bore 50. Oil is provided to the second end 20 of the valve lifter 10 by the camshaft 14. Camshaft 14 is located within the engine block 52 and preferably is covered in oil resulting from oil that bleeds past camshaft bearings and is slung by centrifugal force off of the camshaft 14, as well as oil that bleeds past the lifters and down onto the camshaft 14. As the camshaft 14 rotates within the engine block 52, oil is carried on the individual cam 54 which contacts with the cylindrical roller 32 located in the second end 20 of the valve lifter 10. As the cam 54 and cylindrical roller 32 engage, oil enters the first oil feed slot 42 and the second oil feed slot 44 located on the first side 28 and the second side 30 of the fork housing 26 of the valve lifter 10, respectively. These oil feed slots 42 and 44 provide oil to the shaft 34 and bearing assembly 36 of the roller 32 which maintains the cylindrical roller 32 in the fork housing 26. This oil serves to prevent wear of the bearing assembly 36 and to maintain adequate rotation of the cylindrical roller 32.

Oiling Channel

In a preferred embodiment of the present invention, the valve lifter 10 incorporates an oiling channel 56. The oiling channel 56 is positioned on the external periphery of the tappet body 16 and preferably extends from the inner planar surface of the first side 28 of the forked housing 26 to the oil pressure feed groove 46. The oiling channel 56 may also be positioned at other locations in a generally longitudinal direction along the external periphery of the tappet body 16. In a preferred embodiment the oiling channel 56 is 0.0313 inches wide and 0.0313 inches deep. However, it will be understood that an oiling channel of varying widths and depths may be provided within the scope of the present invention. The reciprocating motion of the valve lifter 10 in the bore 50 forces oil from the oil pressure feed groove 46 through the oiling channel 56 to the inner planar surface of the first side 28 of the forked housing 26. Thus, the oiling channel 56 directs oil to the oil feed slots 42 and 44 which facilitates movement of pressurized oil to the bearing assembly 36 of the cylindrical roller 32.

Operation

The rotation of the camshaft 14 facilitates the movement of oil to the bearing 36. For example, as the camshaft 14 rotates in a clockwise direction, the cam 54 engages the cylindrical roller 32 causing the cylindrical roller 32 to rotate in a counterclockwise manner. Oil adhering to the surface of cam 54 is transferred to the surface of the cylindrical roller 32. The counterclockwise rotation of the cylindrical roller 32 carries oil on the surface of the cylindrical roller 32 to the opposite side of the valve lifter 10 towards the oil pressure feed groove 46. The oiling channel 56 on the opposite side of the valve lifter 10 further directs oil from the oil pressure feed groove 46 to first and second oil feed slots 42 and 44.

The oiling channel 56 facilitates the movement of oil from the oil pressure feed groove 46 as the valve lifter 10 reciprocates in the cylindrical bore 50 of the engine block 52. Furthermore, the oiling channel 56 redirects oil traveling on the surface of the cylindrical roller 32. Once in the oiling channel 56, oil can enter the first and second oil feed slots 42 and 44 and be directed to the bearing 36 of roller 32. Oil at the bearing 36 provides lubrication of the bearing members 40.

In view of the wide variety of embodiments to which the principles of the invention can be applied, it should be understood that the illustrated embodiments are exemplary only, and should not be taken as limiting the scope of the present invention. For example, more or fewer elements or components may be used in the figures.

The claims should not be read as limited to the described order or elements unless stated to that effect. In addition, use of the term "means" in any claim is intended to involve 35 U.S.C. §112, paragraph 6, and any claim without the word "means" is not so intended. Therefore, all embodiments that come within the scope and spirit of the following claims and equivalents thereto are claimed as the invention.

I claim:

1. A valve lifter for use in an internal combustion engine having a plurality of valve members and a camshaft with cams that provide for reciprocating movement of the valve members, the valve lifter comprising:

a cylindrical tappet body having a first end adapted to be operatively connected to a valve member, and a second end opposite the first end including a housing portion;

a roller member for engaging one of the cams and including a bearing assembly rotatively mounting the roller to the housing portion;

an oil feed slot on the second end of the tappet body comprised of a depression on an inner surface of the housing portion; and an oiling channel on the outer surface of the cylindrical tappet body for directing oil to the roller from an oil receiving location along the body spaced from the roller.

2. The valve lifter of claim 1 wherein the oiling channel has an inlet at the oil receiving location.

3. The valve lifter of claim 1 wherein the oil receiving location is an oil pressure feed groove formed by an annular recess about an axis on the outer surface of the tappet body positioned between the first and second ends.

4. The valve lifter of claim 3 wherein the oiling channel has an exterior inlet at the oil pressure feed groove on the outer surface of the cylindrical tappet body and an exterior outlet at the housing portion.

5. A valve lifter for use in an internal combustion engine having a plurality of valve members and a camshaft with cams that provide for reciprocating the valve members, said valve lifter comprising:

a cylindrical tappet body having a first end adapted to be operatively connected to a valve member, and a second end opposite the first end adapted to engage a cam;

the tappet body further including a cylindrical bore extending from the first end along the longitudinal axis of the body towards the second end;

the second end further including a housing portion having first and second sides for receiving a cylindrical roller, a cylindrical roller having a generally flat first side opposite a generally flat second side, and a circular opening located at a center of the roller adapted to receive a shaft;

the cylindrical roller including a bearing assembly located about the circular opening;

the cylindrical roller being rotatably mounted to the housing portion by the shaft positioned through the roller and connected to the first and second sides of the housing portion;

an oiling channel extending longitudinally on the exterior of the tappet body from the first end towards the second end;

the tappet body further including an oil pressure feed groove;

the second end of the tappet body further including an oil feed slot comprised of a depression on an inner planar surface of one of the sides of the housing portion; and the oiling channel connecting the housing portion of the second end and the oil pressure feed groove.

6. The valve lifter of claim 5, wherein the oiling channel is approximately 0.0313 inches wide and 0.0313 inches deep.

7. A valve lifter for use in an internal combustion engine having a plurality of valve members and a camshaft with cams that provide for reciprocating movement of the valve members, the valve lifter comprising:

a cylindrical tappet body having a first end adapted to be operatively connected to a valve member, and a second end opposite the first end including a housing portion;

a roller member in the housing portion; and an oil pressure feed groove on the tappet body;

an oil feed slot comprised of a depression on an inner surface of the housing portion;

the tappet body further including an oiling channel on the outer surface of the tappet body for directing oil to the roller from an oil receiving location along the body spaced from the roller;

wherein the oiling channel originates at the oil pressure feed groove and exits at the housing portion.

8. The valve lifter of claim 7 wherein the oil pressure feed groove comprises an annular recess about the longitudinal axis of the tappet body.

9. The valve lifter of claim 7, wherein the oiling channel is approximately 0.0313 inches wide and 0.0313 inches deep.

* * * * *